US008800801B2

(12) United States Patent
Freeman

(10) Patent No.: US 8,800,801 B2
(45) Date of Patent: Aug. 12, 2014

(54) LIQUID-DISPENSING COMPARTMENTED LID

(76) Inventor: Glen D. Freeman, Van Buren, AR (US)

( * ) Notice: Subject to any disclaimer, the term of this patent is extended or adjusted under 35 U.S.C. 154(b) by 0 days.

(21) Appl. No.: 13/199,874

(22) Filed: Sep. 12, 2011

(65) Prior Publication Data

US 2012/0125949 A1 May 24, 2012

Related U.S. Application Data

(63) Continuation-in-part of application No. 11/796,839, filed on Apr. 30, 2007, now abandoned.

(60) Provisional application No. 60/808,754, filed on May 26, 2006, provisional application No. 60/842,851, filed on Sep. 6, 2006.

(51) Int. Cl.

| | |
|---|---|
| ***B65D 1/24*** | (2006.01) |
| ***B65D 51/00*** | (2006.01) |
| ***B67D 7/74*** | (2010.01) |
| ***B65D 51/28*** | (2006.01) |

(52) U.S. Cl.

CPC ..... *B65D 51/28* (2013.01); *B65D 2205/00* (2013.01); *B65D 2543/00046* (2013.01)

USPC ..... 220/521; 220/212; 222/129

(58) Field of Classification Search

USPC ..... 220/521, 212, 501, 502, 555, 526, 711, 220/718; 222/129, 145.1; 206/219–222, 206/568; 426/86

See application file for complete search history.

(56) References Cited

U.S. PATENT DOCUMENTS

| | | | | |
|---|---|---|---|---|
| 5,215,214 | A * | 6/1993 | Lev et al. | 222/1 |
| 5,398,843 | A * | 3/1995 | Warden et al. | 220/711 |
| 5,588,561 | A * | 12/1996 | Ness | 222/129 |
| 6,305,571 | B1 * | 10/2001 | Chu | 220/719 |
| 7,185,781 | B2 * | 3/2007 | Pitts | 220/367.1 |
| 7,448,510 | B2 * | 11/2008 | Pavlopoulos | 220/501 |

* cited by examiner

*Primary Examiner* — Bryon Gehman
*Assistant Examiner* — Shawn M Braden
(74) *Attorney, Agent, or Firm* — Bell & Associates; Matthew Kaser; Adam Warwick Bell

(57) ABSTRACT

The invention presents a compartmented lid for conveying at least two liquids simultaneously, the compartmented lid comprising a lid, the lid further comprising a rim, a substantially flat top crowning the rim, the top further comprising an exterior surface, an interior surface, and at least one portal with an aperture; and a compartment comprising an inner wall, the compartment further comprising a basin operably attached to the interior surface of the top of the lid and at least one channel located on the inner wall of the compartment. An opening formed by the channel for dispensing a liquid or other product stored within the confines of the basin is formed when a cover is secured to the upper portion.

11 Claims, 9 Drawing Sheets

LIQUID-DISPENSING COMPARTMENTED LID

RELATED APPLICATIONS

This is a Continuation-in-part of U.S. Non-provisional patent application Ser. No. 11/796,839, filed 30 Apr. 2007 that claims the benefit of U.S. Provisional Application No. 60/842,581 filed 6 Sep. 2006 and 60/808,754 filed 26 May 2006, each incorporated by reference herein in its entirety.

FIELD OF THE INVENTION

The field of the invention is a liquid-dispensing compartmented lid or apparatus for conveying at least two liquids directly and simultaneously into the mouth of a consumer.

BACKGROUND OF THE INVENTION

In the modern world, people move about at an ever increasing pace. They are often in a hurry to get to work and to get home. The fast food industry has taken note of this increased pace; and restaurants, as well as many other venues, sell food and drinks from a drive-through or take-out window.

During a typical morning commute, it is not uncommon to see a driver trying to remove the lid from a cup of coffee in order to add condiment(s). This process is distracting even in light traffic and often less than successful. In some cases, a tiny container of cream splashes or spills while being opened to add to the coffee; or sugar or a powdered sweetener falls undissolved to the bottom of the container because the driver cannot manage to stir it while driving. Greater distraction results when an open container of the hot beverage splashes or spills in the car or on the driver.

The service representative at the take-out window does not have time to mix condiments into a cup of coffee as it is sold, and the driver rarely takes time to stop the car and mix the condiments into the coffee before pulling out into traffic. Thus, there is a need in the art for a liquid-dispensing apparatus or a compartmented lid that can convey at least two liquids, such as creamer and a beverage, simultaneously and directly into the mouth of the consumer. The advantages include reducing the number of products and packets handled by service representatives; eliminating the need for the consumer to add and mix condiments into a beverage and the distractions mentioned above.

SUMMARY OF THE INVENTION

The invention provides a compartmented lid and a liquid-dispensing apparatus for conveying at least two liquids simultaneously and directly into the mouth of a consumer, one of the liquids is at least one liquid conveyed from the compartment of the lid, and the other liquid is a beverage or water conveyed from a beverage container operably engaged to the compartmented lid.

The invention presents a compartmented lid for conveying at least two liquids simultaneously, the compartmented lid comprising a lid, the lid further comprising a rim, a substantially flat top crowning the rim, the top further comprising an exterior surface, an interior surface, at least one portal comprising an aperture for conveying a first liquid therethrough, a closure, and a compartment, the compartment further comprising a basin operably attached to the interior surface of the top of the lid, the basin comprising a wall, wherein a portion of the basin wall comprises at least one channel for conveying at least one second liquid therethrough. In one embodiment, the rim slopes vertically over its circumference from about 0.25 to about 1 inch in height. In a second embodiment, compartmented lid further comprises a closure. In a third embodiment, the aperture of the portal is pre-perforated.

The invention also presents a compartmented lid for passively delivering at least two liquids simultaneously, the compartmented lid comprising a lid, the lid further comprising a rim, a substantially flat top crowning the rim, the top further comprising an exterior surface, an interior surface, and at least one portal with a first aperture for conveying a first liquid therethrough, a closure, and a compartment, the compartment further comprising a shell or housing, the shell or housing further comprising at least one channel for conveying at least one second liquid therethrough. In one embodiment, the first and second apertures are pre-perforated. In another embodiment, the compartmented lid further comprises an opener.

The invention further presents a compartmented lid for conveying at least two liquids simultaneously, the compartmented lid comprising a lid, the lid having an annular rim, a top crowning the rim, the top further comprising at a well, at least one first vent, an exterior surface, an interior surface, and at least one portal having at least one first aperture for conveying a first liquid therethrough, a closure, and a compartment further comprising at least one second vent, a cover operably attached to the exterior surface of the top of the lid, and at least one second aperture wherein a portion of the cover containing the at least one second aperture bisects or partitions the at least one first aperture of the portal for conveying one or more additional liquids from the compartment therethrough.

The invention still further presents a liquid-dispensing apparatus for conveying at least two liquids, the apparatus comprising a beverage container and a compartmented lid operably engaging the beverage container, the lid further comprising a rim, a substantially flat top crowning the rim, the top further comprising at least one first vent, an exterior surface, an interior surface, and at least one portal with a first aperture for conveying a first liquid therethrough, a closure, and a compartment with at least one second vent, the compartment further comprising a shell or housing having at least one channel for conveying at least one second liquid therethrough.

The invention yet still further presents a liquid-dispensing apparatus for conveying at least two liquids simultaneously, the apparatus comprising a beverage container and a compartmented lid that operably engages the beverage container, the compartmented lid comprising a lid, the lid further comprising a rim, a substantially flat top crowning the rim, the top further comprising at least one first vent, an exterior surface, an interior surface, and at least one portal with at least one first aperture for conveying a beverage or water therethrough, a closure, and a compartment, the compartment further comprising a shell or housing with at least one second vent and at least one second aperture wherein a portion of the shell or housing containing the second aperture bisects or partitions the first aperture of the portal for conveying one or more additional liquids from the compartment therethrough.

In one aspect, the circumference of the rim of the compartmented lid varies from about 0.25 to about 1 inch in height, and the portal is located on the peak of the rim. In a second aspect, the compartment further comprises a baffle that subdivides the compartment and/or provides structural integrity to the lid. In a third aspect, the closure has a tooth or tooth-like projection for opening pre-perforated apertures.

In a fourth aspect, the beverage container, the compartmented lid, the closure and the opener are manufactured from liquid- and beverage-resistant materials using at least one process selected from blow molding, die cutting, die pressing, die stamping, extrusion, vacuum infiltration, injection molding, rotational molding, thermoforming, thermoplastic molding and thermosetting. In a fifth aspect, the liquid- and beverage-resistant materials are paper or organic polymers selected from cellulosics, coated paper, nitrile resins, paper slurry, polybutylene, polyethylene, polyethylene terphthalate, polystyrene, polyvinylchloride thermoplastic resins, and thermosetting resins. In a sixth aspect, the manufacturing process can include pre-perforation of the apertures in the portal and the shell or housing of the compartment and formation of vents, or the vent in the compartment can be formed during the filling of the compartment with liquid. In a seventh aspect, the compartmented lid and beverage container are disposable or reusable.

DETAILED DESCRIPTION OF THE INVENTION

Definitions

Figure 1:
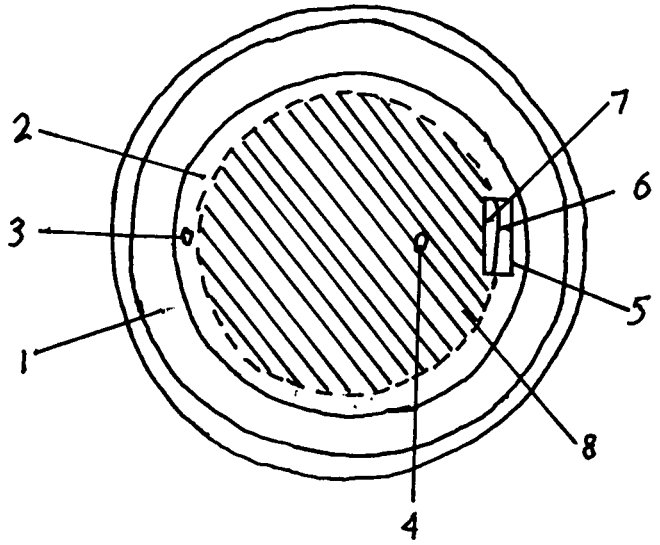
FIG. 1 shows a compartmented lid as viewed from the top.

Unless defined otherwise, all terms are understood to have the same meaning as commonly used in the art to which they pertain. In this application, the singular forms "a", "an", and "the" include plural references unless the context clearly dictates otherwise. It is noted that any of the embodiments disclosed herein may be used in various and any combination that can be of benefit. For the purpose of this invention, the following terms are defined below.

"Apparatus" refers to a beverage container and a compartmented lid.

"Aperture" refers to a pre-perforated area or an opening into the compartment or portal of a compartmented lid or apparatus.

"Baffle" refers to a wall or divider that can be used to provide support or structural integrity within a compartment and/or to subdivide the compartment so that more than one liquid (ie, cream on one side, sweetener on the other side) can be conveyed simultaneously.

"Beverage" refers to any consumable liquid including, but is not limited to, alcohol, carbonated, fresh or mineral water, a diet drink, coffee, fruit or vegetable juice, lemonade, milk, pop or soda, tea, tonic, and the like.

"Beverage container" is used in its broadest sense to refer to any container for a hot or cold consumable liquid, with or without a handle, including but not limited to a bottle, a can, a cup, a glass, ajar, a mug, or any vessel that can be capped, mated, or sealed with a liquid-dispensing compartmented lid.

"Closure" refers to any size or shape piece of liquid- and beverage-resistant material including but not limited to adhesive film, coated-paper, foil or plastic tape and the like that can be used to seal or reseal an aperture of a compartment, portal, shell or housing and any vents in the compartmented lid. Additionally, the closure can have an edge, projection, or tooth that can be used to open any pre-perforated aperture of the lid or compartment.

"Compartment" refers to a basin, a box, a chamber, a housing, a receptacle, a shell, a tub, or a well that can be subdivided at least once and is an integral part of, formed on, operably attached or sealed to, the top or bottom of a compartmented lid.

"Lid" refers to any removable cap made from any liquid- and beverage-resistant material having a rim or lip that can operably engage a beverage container and a liquid-dispensing compartment for conveying at least two liquids simultaneously.

"Liquid" is used in its broadest sense to refer to any drinkable fluid that adds flavor, medicine, nutrients, palatability, or pleasure to the consumption of a hot or cold beverage including but not limited to an alcohol such as gin, scotch, vodka, whiskey, and the like; cream, an artificial creamer, or milk of a variable percent cream or nonfat; a broth concentrate including beef, chicken, fish, pork, turkey, or vegetable; a cola concentrate; a coffee extract made by Cuban, Italian, Turkish or any other process; a pure or mixed fruit juice, a medicine, a mixer for an alcoholic drink, a nutritional solution or dietary supplement, a rehydrating solution; a tea including blended, black, ginseng, green, herbal, jasmine, and orange pekoe; flavorings such as almond, apple, anise, banana, bergamot, blueberry, blackberry, butterscotch, cappuccino, caramel, cardamom, carrot, caramel, cashew; cherry including bing, black, maraschino, red, sweet, sour and wild; chicory, cinnamon, chocolate, coconut, cola, coffee, cranberry, currant, expresso, ginger, grape, grapefruit, hazelnut, kiwi, lemon, licorice, lime, macadamia, mango, maple, melon, mocha, mulberry, nutmeg, orange, papaya, passion fruit, peach, peanut, pecan, peppermint, pineapple, pistachio, pomegranate, pumpkin, black or red raspberry, root beer, spearmint, strawberry, tangerine, black walnut, wintergreen, vanilla, and combinations thereof; and artificial or natural sugars, sweeteners, syrups, and the like.

"Liquid- and beverage-resistant" refers to materials for manufacturing a beverage container, compartmented lid or closure such as paper or organic polymers that are resistant to alcohol, grease, heat and water including but not limited to cellulosics, foams, nitrile resins, paper slurries, thermoplastic resins and thermosetting resins including but not limited to polybutylene, polyethylene, polyethylene terephthalate, and polystyrene; and plastisols (ie, dispersion grade polyvinylchloride resin in a plasticizer) that are used to form or coat the container, lid or closure.

"Operably attached" refers to any means or mechanism by which a closure, a compartment, an opener, or a screen is adhered, connected, glued, sealed, thermoformed, or thermoset to any part of the liquid-dispensing compartmented lid or apparatus or to a pre-existing lid for a beverage container.

"Operably engaged" refers to any means by which the rim of a lid attaches to, connects with, grips, mates with or snaps onto a beverage container.

"Peak" refers to the point of highest elevation(s) on the rim of the compartmented lid.

"Portal" refers to an area on the top of a compartmented lid at the peak of the rim that has an aperture through which a consumer simultaneously drinks a beverage from a beverage container and a liquid from a compartmented lid.

"Vent" refers to a rimmed perforation or other opening for releasing steam from the beverage container and allowing air to flow into the compartment and container and maintain an even flow rate when the liquids are being sipped.

Description

The invention presents a compartmented lid and a liquid-dispensing apparatus for conveying at least two liquids simultaneously. The compartmented lid and apparatus convey at least one liquid from the compartment and a beverage or water from a beverage container simultaneously and directly into the mouth of the consumer.

Figure 2:
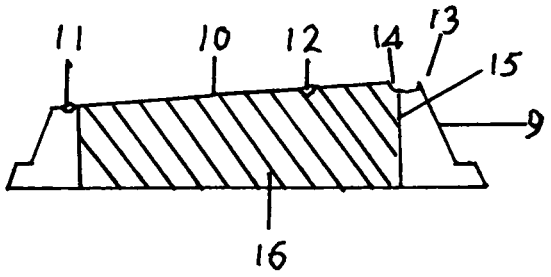
FIG. 2 shows a compartmented lid as viewed in cross-section.

FIGS. 1 and 2 show the preferred embodiment of the liquid-dispensing compartmented lid. FIG. 1 shows a top view of the compartmented lid with a sloping annular rim (1) and a substantially flat top (2) crowning the rim. The top has two vents, one into the beverage container (3) and one into the compartment (4), and a portal or drinking portal (5) with an aperture adjacent to the rim. The aperture of the portal is partitioned into a peripheral portion (6) confluent with the beverage container and a central portion (7) confluent with the compartment. The top has an exterior surface (8) and an interior surface (not shown in this view). The location of the liquid-dispensing compartment that is a part of the lid or operably attached to the interior surface of the top of a lid is shown cross-hatched. In some embodiments, the aperture of the portal is pre-perforated.

FIG. 2 shows a cross-section of the compartmented lid. The lid has a sloping annular rim (9) that varies from about from about 0.25 to about 1.0 inch, above the point where it operably engages the beverage container. The rim is crowned by a more or less flat top (10) with at least one first vent (11) into the beverage container and at least one second vent (12) into the compartment. The drinking portal (13) located on the top of the lid at the peak or highest elevation of the rim has an aperture (14) confluent with any operably engaged beverage container. For a usual 6-16 oz cup, a preferred height of the portal is about 1 inch although for other cup sizes, the height of the rim can vary from 0.01 to about 2 inches. The partitioning of the aperture occurs when the basin (15) bisects or partitions the first aperture of the portal during manufacture or when the compartment is operably attached to the lid.

As can be seen in FIG. 2, the general configuration of the compartmented lid with a single portal, and the compartment (16, cross hatched), is more or less trapezoidal. In cross-section, the general configuration of the top of a compartmented lid with two portals would be a more or less flattened V-shape; and from a top view (using a clock face for reference), the lowest portions of the rim of a circular lid would occur at 12 and 6 and the highest elevation or peaks, at 9 and 3 (with 9 and 3 positioned on the tips of the V).

Figure 3:
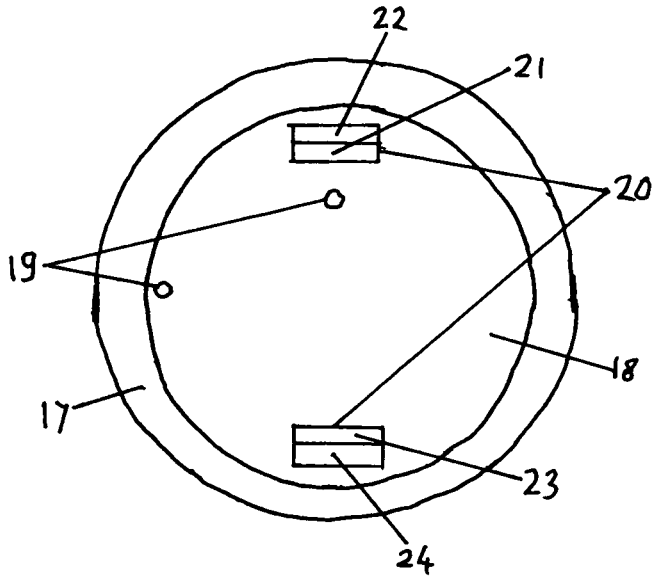
FIG. 3 shows a compartmented lid with two drinking portals as viewed from the top.

The portals of the preferred compartmented lid and liquid-dispensing apparatus are purposefully elevated. Testing of many prototypes showed that placing the portal at the peak of the rim optimized the flow of the liquid from the compartment and the beverage from the container into the mouth of the consumer. Another advantage of the elevation is that the compartment is raised above the normal fill level of the beverage container so that none of the beverage volume is sacrificed to accommodate the compartment. If the compartmented lid has more than one drinking portal, the consumer can choose to open and use the portal that mixes the liquid and beverage to his/her preferred taste. The top view of a compartmented lid having two portals is shown in FIG. 3, where the rim (17) is crowned with a top (18) having two vents (19), one into the container and one into the compartment. In FIG. 3, the lid is the cover of the compartment (not shown in this view) which bisects the apertures of the portals (20) so that each aperture releases different amounts of beverage and liquid. The portal located at the top of the drawing in FIG. 3 shows a greater proportion of the aperture (20) devoted to dispensing liquid from the compartment (21) and less of the aperture (22) devoted to releasing beverage from the container. Conversely the portal at the bottom of FIG. 3 shows less of the aperture (20) devoted to dispensing liquid from the compartment (23) and more of the aperture (24) devoted to releasing beverage from the container. In one embodiment, the aperture is bisected by a portion of the basin and in another, by the attachment and positioning of the pre-perforated aperture of the shell or housing (not shown) within the aperture of the portal.

The compartmented lid can vary in shape according to the shape of the beverage container which it caps, but the most common shape is circular. The compartmented lid can vary in the size in order to match the size of the beverage container. It can be very small and used with a small container containing from about 2 to about 5 fluid oz, with a regular size container from about 6 to about 12 fluid oz, or with a large container containing from about 13 to about 32 or more fluid oz of beverage. The compartment can also vary in size, although it is always smaller in diameter (or dimension) than the top (2) or cover (18, 38) of the lid. When formed or operably attached to the lid, it can occupy up to about 90% of the top the lid's interior volume as long as it does not prevent air from entering the vents or interfere with the formation of a proper seal when the rim of the lid operably engages the container. The quantity of liquid in the compartment can vary with the shape and size of the beverage container.

The basin, housing or shell of the compartment is more or less well-like and can be of cuboidal, hemispherical, rhomboidal, trapezoidal, or any other useful shape. It is contemplated that a piece of screen can be attached to the bottom of compartment to prevent ice or tea leaves from the beverage container from clogging the portal as the consumer drinks. The dimensions, composition, stiffness, and size of the screen can vary.

The portal and the apertures confluent with the container and compartment can vary in size and shape. The portal or apertures can be can be oval, rectangular, round, square, trapezoidal, tubular or any other convenient or desired shape. The overall size of the first aperture in the portal can range from about 0.25 to about 0.5 inches in width and from about 0.25 to about 0.75 inches in length. This size range more or less prevents the beverage from sloshing out of the container; and if the beverage container and lid overturn, the contents of both compartment and container drain or spill more slowly than an open container. In the preferred embodiments, the compartment is more or less centered in the lid to partition the portal or its pre-perforated apertures are positioned to occupy the central portion of the aperture of the portal.

The quantity of liquid in the compartment can vary with the size and volume of the beverage container and with the concentration and flow rate of the liquid(s). Flow rate can be adjusted by changing either concentration or the size of the aperture or proportion of the aperture devoted to dispensing it. In one embodiment where the liquid is cream for a container of coffee, the compartment partitions about 20% of the aperture of the portal. In another embodiment where a liquid such asalcohol has less viscosity, the compartment partitions about 10% of the aperture.

In the preferred embodiment, both the lid and compartment have at least one vent. The vent allowing air into the beverage container is formed when the lid is manufactured and is relegated to a position near or on the rim not affected by the formation or attachment of the compartment or by the rim operably engaging the beverage container. The vent allowing air to flow into the compartment is formed when the lid is manufactured or the compartment is filled.

The apertures and vents of the invention can be sealed with a closure. Preferably, the closure is applied to the lid at the time the compartment is filled and remains in place until it is removed by the consumer. The closure can be any shape including oval, rectangular, round, square, triangular, and, the like, and made from any thin, pliable material such as liquid- and beverage-resistant coated paper, foil, plastic, and the like with adhesive on one side. The closure can be slightly shorter than any dimension of the lid to which it is operably attached. One preferred closure is a plastic rectangle from about 0.2 to about 1.0 inches wide and approximately 1.0 inch long with one toothed or pointed (as opposed to rounded). In one alternative, the closure can have a tooth about 2 mm in length that can be used to open a pre-perforated aperture.

The compartmented lid or the compartment can be subdivided using at least one baffle. Subdivision of the compartment into subcompartments or wells is particularly useful when one of the liquids might not be stable if mixed with another and stored for a long time. In a compartment containing two wells for liquids, each well opens into or has a pre-perforated aperture that opens into that portion of the drinking portal allotted to the compartment. The wells can be the same or different sizes, and they can be filled with equal or different volumes of liquid. For example, in a compartment subdivided into wells for cream and sweetener, the well for cream can hold a larger volume than the well for sweetener due to the concentrated nature of the most liquid sweeteners.

Figure 4:
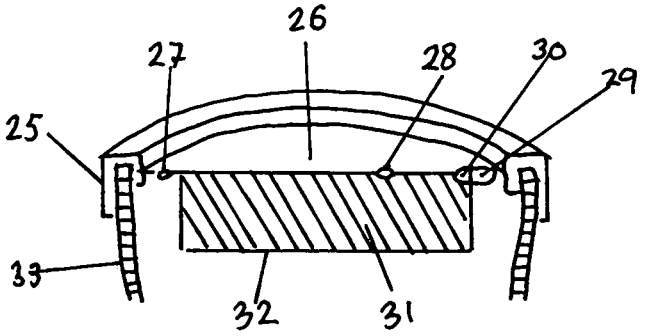
FIG. 4 shows one liquid-dispensing apparatus having a flat compartmented lid operably engaging a beverage container as viewed in cross-section.

FIG. 4 shows a liquid-dispensing apparatus having a substantially flat, compartmented lid operably engaging a beverage container. In this embodiment, the compartmented lid has little or no rim (25) although other parts are similar to those of the preferred embodiments: a substantially flat top (26) with a vent into the beverage container (27) and vent into the compartment (28) and a portal having an aperture. One portion of the aperture (29) is confluent with the beverage container, and another portion of the aperture (30) is confluent with the basin (31) of the compartment (32). This particular configuration of the compartmented lid would require that the compartment be located almost entirely within the beverage container (33). It is contemplated that the amount of beverage can be reduced slightly, if necessary, to accommodate the compartment of the flat compartmented lid within the beverage container.

In some embodiments, the top of the compartmented lid can be the bottom of the compartment, and the compartment is formed when a cover is glued, sealed or snapped onto the exterior surface of the top of the lid. Such a compartmented lid comprises a rim, a top with at least one first vent, the top further comprising a well, an exterior surface, an interior surface crowning the rim, and at least one portal having a first aperture; and a compartment with at least one second vent, the compartment further comprising a flat or a more or less convex cover operably attached to the exterior surface of the top of the lid and a second aperture adjacent to the first aperture.

Figure 5:
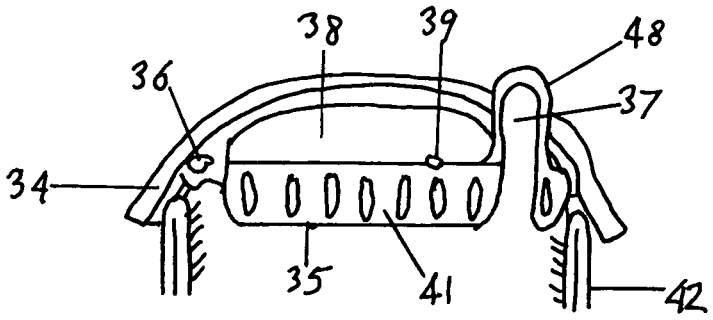
FIG. 5 shows another liquid-dispensing apparatus with compartmented lid operably engaging the top of a beverage container as viewed in cross-section.

The liquid-dispensing apparatus shown in FIG. 5 comprises a compartmented lid with a rim (34) and a top crowning the rim. A centrally located area of the top of the lid is concave and forms a well (35). The periphery of the lid is substantially flat and has a vent (36) into the container. One circular portion of the well slopes upward to form part of a drinking portal (37). A cover (38) forms the compartment and has at least one vent (39), preferably introduced during the filling process. A portion of the cover also slopes upward to form the part of the portal (40). The compartment has a baffle with slots (41) that allow a single liquid to move freely through and out of a single welled compartment. The rim of the lid operably engages the beverage container wall (42).

In FIG. 5, it is the portal rather than the rim that is elevated, and the portal can extend from about 0.25 to about 2.0 inches above the top of the lid or beverage container and can have pre-perforated tip(s) that can be snapped open. Although the portal of FIG. 5 is more or less tubular, it is contemplated that a portal formed by the compartment and/or the top of the lid can have several other shapes and configurations that allow the liquid from the compartment and any beverage from the beverage container to merge simultaneously from the aperture of the portal. For example, the portal can be circular, elongate, hemispherical, oval and the like. Since it is contemplated that the flow of beverage will generally exceed the flow of liquid, the diameter aperture of the portal confluent with the beverage container will be greater than that of portion confluent with the compartment. Preferably, materials chosen to make the lid of FIG. 5 are sturdy enough to prevent the portal from collapsing or crushing during use of the apparatus or lid. The use of a baffle also adds to such structural integrity.

Figure 6:
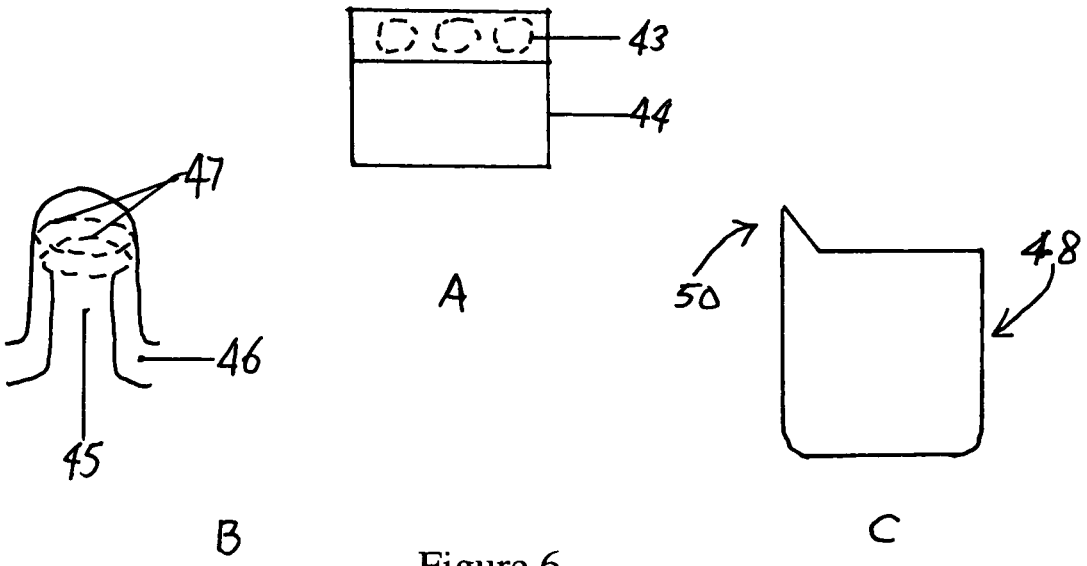
FIG. 6 shows a top view of the aperture of a portal of a compartmented lid bisected by a portion of the shell of a compartment in which there are three, pre-perforated apertures (A), a top view of portal of a liquid-dispensing apparatus showing a portal with pre-perforated apertures (B) formed by the cover and top of the compartmented lid, and side view (C) of a simple compartment closure (48) or opener with one tooth (50).

FIG. 6 shows drinking portals (A and B) and a compartment closure/opener C. Portal A is viewed from above and shows three pre-perforated apertures into the compartment (43), and the larger aperture into the beverage container (44) which may or may not be pre-perforated. The consumer can choose to open one, two or three of the apertures. Differences in the concentration and flow rate of the liquid in the compartment or the taste desired by the consumer can determine the number of the pre-perforated apertures that are opened to release liquid from the compartment. Portal B is a concentric tubular portal with one aperture into the beverage container (45) and one aperture into the compartment (44). The pre-perforated tips of each tube (47) are shown in a slightly expanded view; otherwise the pre-perforations indicated by the dashed lines would occur at almost exactly the same level and be indistinguishable in the drawing. A simple compartment closure (C) with one tooth is shown.

Figure 7:
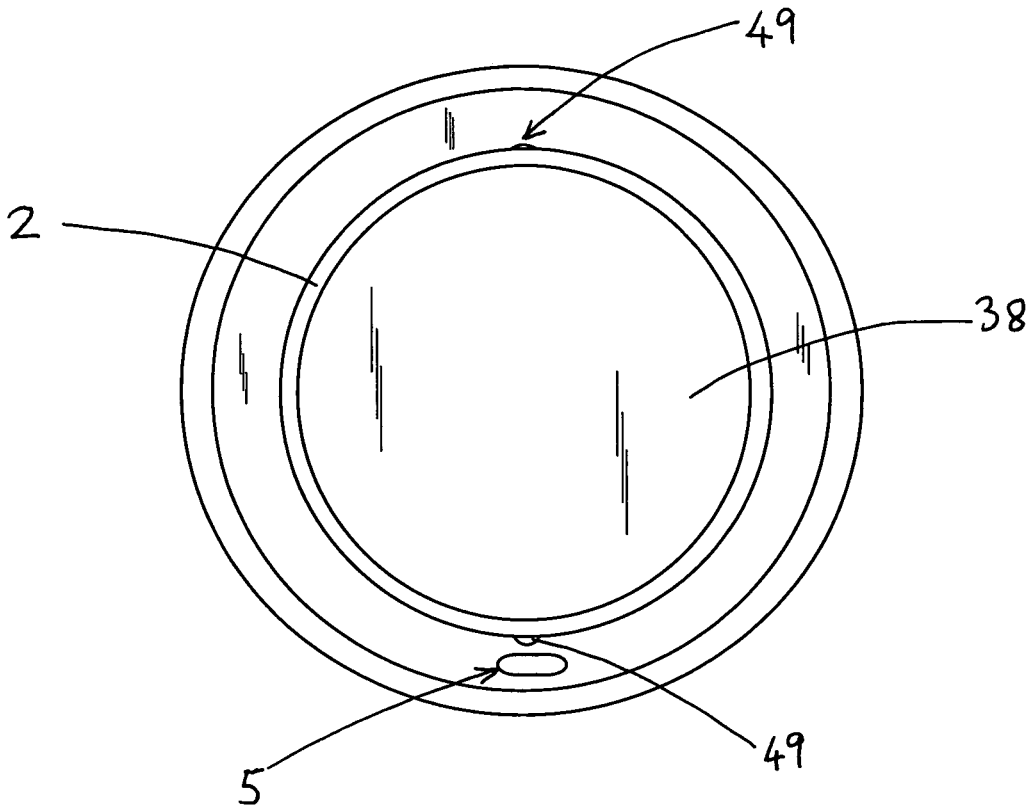
FIG. 7 is a perspective view of a liquid-dispensing compartmented lid viewed from above.
Figure 9:
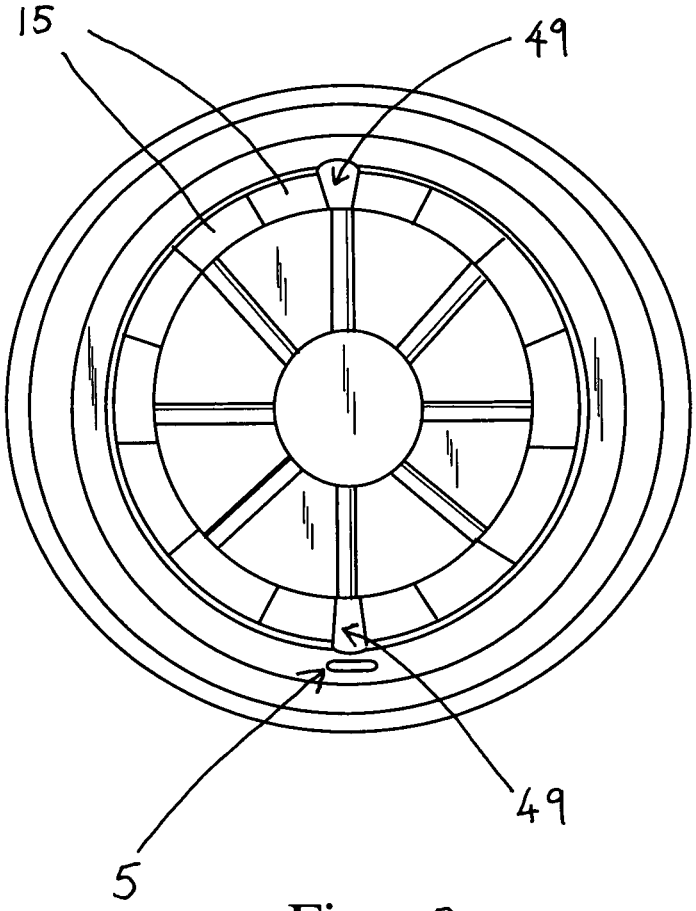
FIG. 9 is a perspective view from above of the liquid-dispensing compartmented lid without the top or cover showing the two channels.
Figure 11:
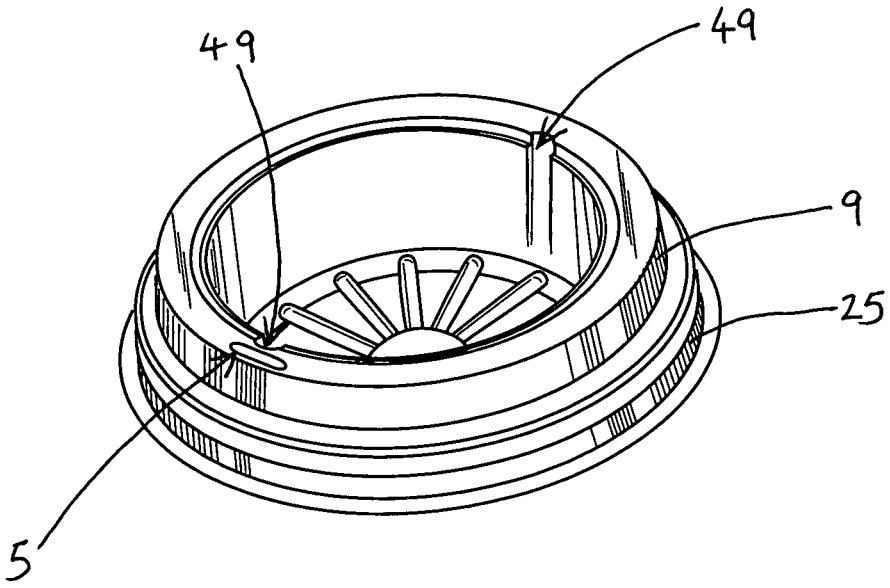
FIG. 11 is the same three-quarters perspective view of FIG. 10 without the top or cover to show the elements of the lid within.
Figure 12:
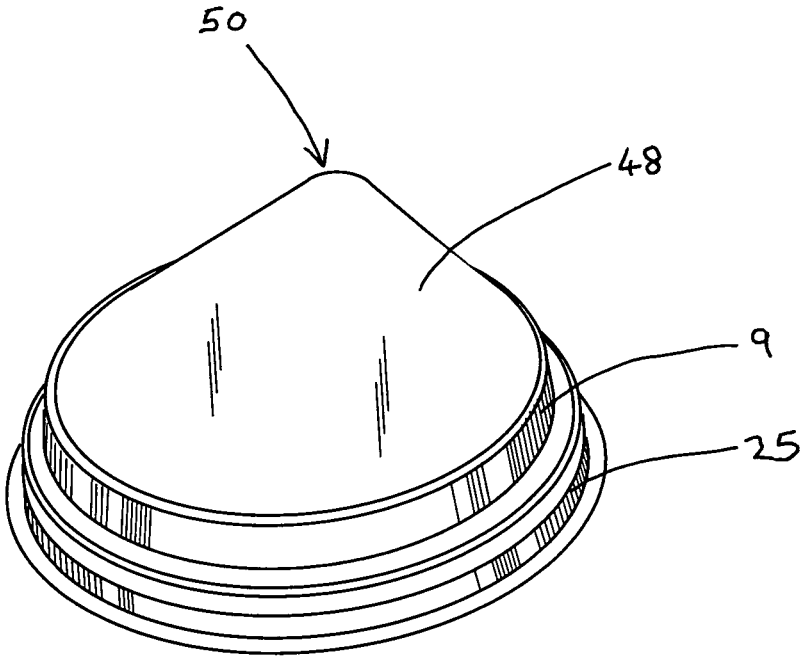
FIG. 12 is the same three-quarters perspective view of FIG. 10 showing the liquid-dispensing compartmented lid having an optional closure or seal.
Figure 13:
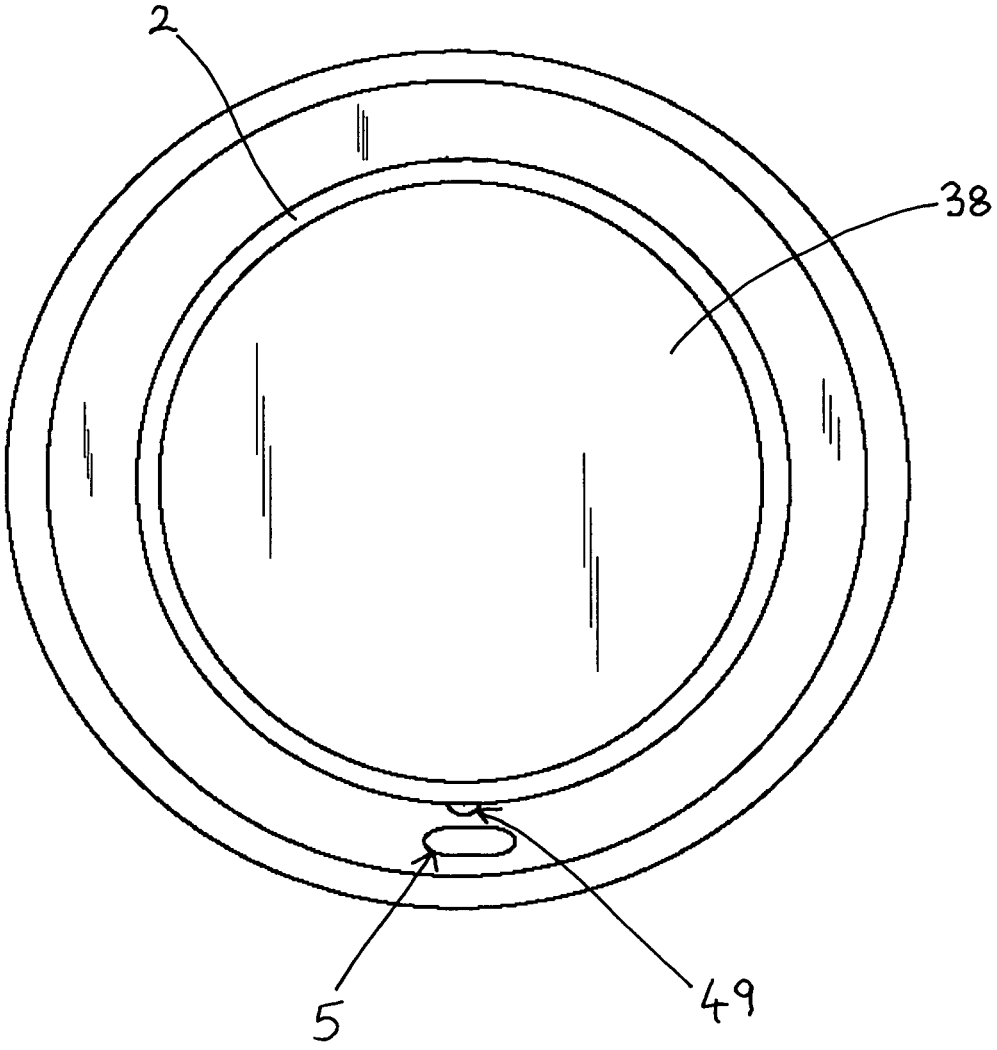
FIG. 13 is a perspective view if a liquid-dispensing compartmented lid viewed from above, the inner surface of the compartment having a single channel.

FIGS. 7, 9, and 11 show an embodiment of the invention wherein the inner surface of the compartment wall (15) comprises at least one channel (49). The cross-sectional form of the channel can be 'U'-shaped, it can be 'V'-shaped, or it can be in the shape of a parabola. The width of the channel can have any dimension suitable for the size of the lid itself. For example, the width of the channel from edge to edge can be 1 mm, it can be 1.5 mm, it can be 2 mm, it can be 2.5 mm, it can be 3 mm, it can be 4 mm, it can be 5 mm, it can be 6 mm, it can be 7 mm, it can be 8 mm, it can 9 mm, it can be 10 mm, it can be 11 mm, it can be 12 mm, it can be 13 mm, it can be 14 mm, it can be 15 mm, it can be 16 mm, it can be 17 mm, it can be 18 mm, it can be 19 mm, it can be 20 mm or any dimension therebetween. Other larger dimensions are also contemplated and which may be used if the lid is adapted for use with solid, semi-solid, or semi-fluid foodstuffs, such as soups, stews, pot-noodles, syrups, including honey, molasses, maple syrup, and synthetic syrups, foodstuffs in powdered form, such as sugar, sweeteners, dairy products, creamers, chopped fruit and/or vegetables or other plant materials suitably prepared, such as wheat grass, and the like. The channel (49) may be created during the manufacturing process, such as by vacuum-forming, and which results in an indentation in the inner wall of the compartment that extends to the substantially flat top (2) or cover (38) of the lid. The advantage of the channel element in the inner wall of the compartment or basin is that it obviates a need or requirement for an additional aperture to be created in the lid or a requirement for additional tubes or straws within the lid to deliver the contents of the compartment or basin. In one embodiment, the inner surface of the compartment comprises one channel. The single channel is desirable as fluid flow of a liquid therethrough is slower than if a second channel positioned on the opposite side to the first channel, the second channel allowing air to enter to allow pressure equalization. A lid having a single channel is of benefit as the decreased relative air pressure within the compartmented lid results in the outflow of the liquid therein to be reduced. One desirable embodiment is that a slower fluid flow of the liquid prevents all the beverage additive(s) from escaping the compartment prior to the user finishing the beverage in the cup upon which the compartmented lid is placed. The compartmented lid further comprises one drinking portal or aperture (5) that conveys the beverage from the cup upon which the compartmented lid is placed or positioned. The compartmented lid further comprises a cover (38) that is shaped and sized to seal the basin but not obstructing the channel in the inner surface of the compartment wall.

Figure 8:
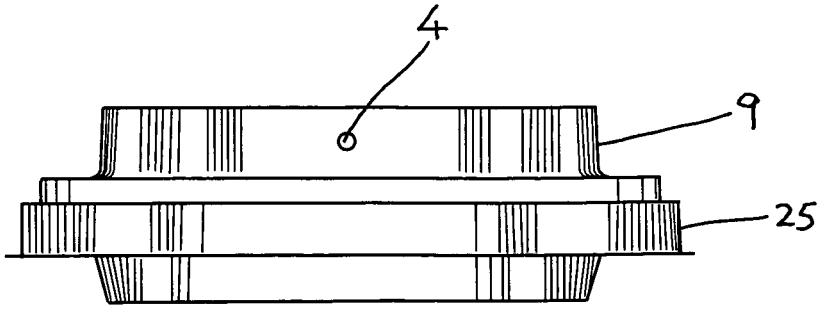
FIG. 8 is a perspective view of the liquid-dispensing compartmented lid viewed from one side.

FIG. 8 illustrates the lid from a side (lateral) perspective showing the vent (4) into the compartment (not shown) of the lid. The lid has a sloping annular rim (9) and an engagement rim (25) that varies from about from about 0.25 to about 1.0 inch, above the point where it operably engages the beverage container.

The novelty of the compartmented lid disclosed herein may be appreciated by those in the relevant art; the entire lid compartment component can be manufactured as one piece and without using additional tools to create holes or apertures within the lid. The top (2) or cover (38) is added next or when the liquid is introduced into the compartment. The drinking portal may be created during the manufacturing process by utilizing molds that are pre-fabricated with a built-in sprue that allows the plastic material to form around it as a portal or aperture. The manufacturing process can be vaccum-forming or injection technology.

Figure 10:
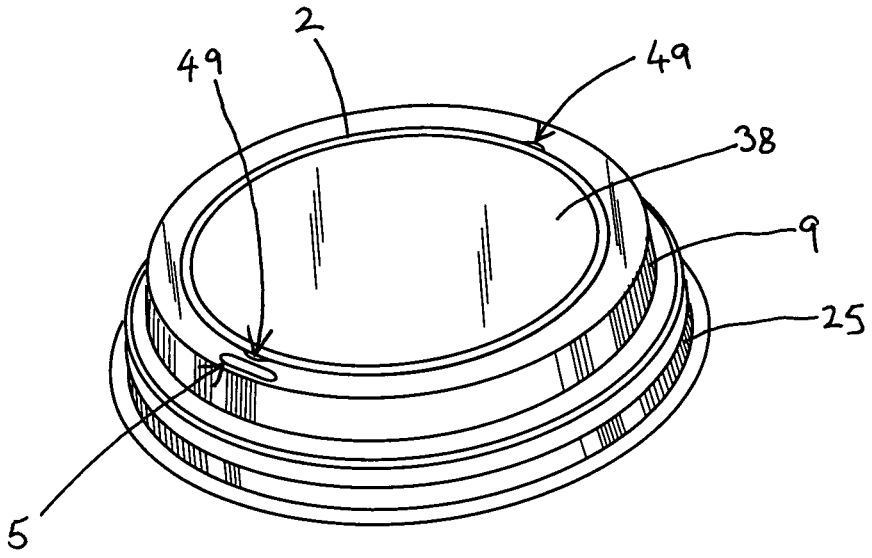
FIG. 10 is a three-quarters perspective view of the liquid-dispensing compartmented lid.
Figure 14:
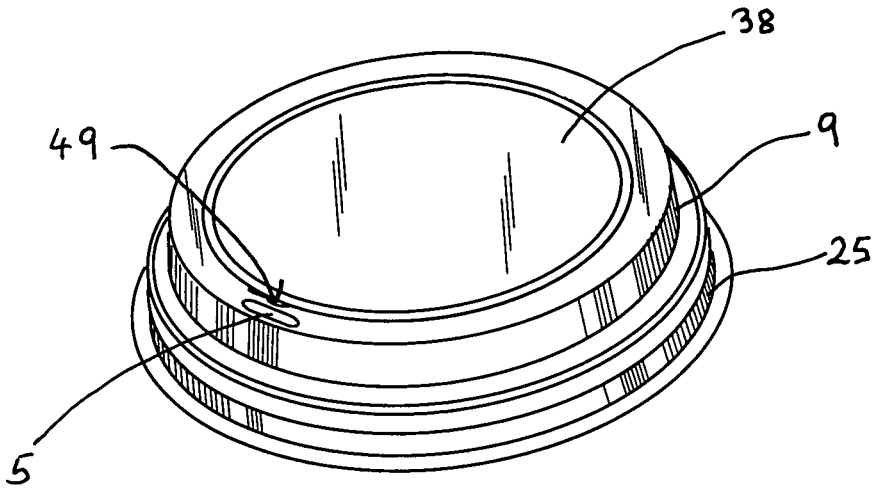
FIG. 14 is a three-quarters perspective view of the liquid-dispensing compartmented lid of FIG. 13.
Figure 15:
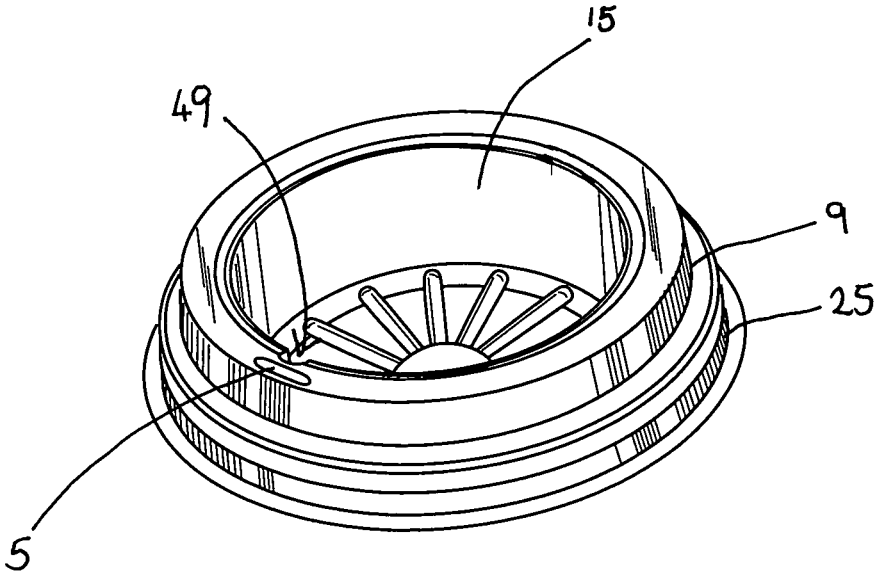
FIG. 15 is the same three-quarters perspective view of FIG. 14 without the top or cover to show the elements of the lid within.

In another embodiment, the inner surface of the compartment wall (15) comprises two channels. In a preferred embodiment the second channel is shaped and sized to allow a specific flow through rate of liquid. The second channel can allow passage of air therethrough to equalize the pressure within the compartment basin. The rate of air passage may be regulated by the size and shape of the second channel thereby preventing rapid depletion of the liquid contents of the compartmented lid. The compartmented lid further comprises one drinking portal or aperture (5) that conveys the beverage from the cup upon which the compartmented lid is placed or positioned. As shown in FIGS. 7, 10, and 14 the compartmented lid further comprises a top (2) or cover (38) that is shaped and sized to seal the basin but not obstructing the two channels in the inner surface of the compartment wall.

The ability of controlling the rate of air passage is of benefit to the user and consumer of the beverages so as to reduce the likelihood of emptying the compartmented lid of liquids, such as flavorings, sweeteners, milk-products, and the like, before the main beverage in the cup is finished.

Any pre-perforated aperture of a portal or compartment is a weakened or partially cut opening of rectangular, round, or any other shape formed during manufacture that can be opened by the consumer. A short straw, such as those supplied with box or pocket beverages, a toothpick or half-toothpick or a closure with a tooth can be attached to the lid or container and used to open any pre-perforated aperture. It is contemplated that an opener can be made of the same material used to manufacture the compartmented lid. If it were attached to the rim, it could be twisted off by the consumer for use; or if manufactured separately, glued to any convenient part of the compartmented lid or apparatus until use.

It is contemplated that the compartment can be manufactured separately from the lid and operably attached to it. In this case, the basin, shell or housing can vary in height and shape to accommodate different volumes of liquid, and the vent to the compartment can be located in the basin, shell, housing or cover and formed during either the manufacturing or filling.

The compartmented lid can be manufactured using several different processes well known in the art. Some of the common processes involve die stamping or pressing of the lid. With vacuum infiltration or injection, a liquid plastic or paper slurry is pulled or injected into a mold, the mold is cooled until the resin sets or the paper dries, and then the mold opened so that the lid can be removed. With stamping or pressing, a heated metal die is used to stamp or press a thin sheet of wet paper or plastic to form the lid. In the case of coated paper products, the formed paper lid is sprayed with or passed through a vat of alcohol-, grease-, heat- and water-resistant coating material. In the preferred embodiment, the lid with top and rim and the compartment with base and sidewalls are formed separately, cooled and removed from the die, and the compartment is operably attached to the inside of the lid using a glue that is FDA-approved for use with food and beverage containers. In the alternative, this same kind of glue can be used to attach a compartment with a cover to a pre-existing commercial lid (for example, a lid manufactured by Solo Cup Company (Highland Park Ill.) or Dart Container Corporation (Mason Mich.).

Once the lid has been manufactured, liquid can be introduced through the opening formed when the basin bisects the aperture of the portal or injected through the top of the lid or the side of the basin, shell or housing. Injection of liquid either produces a vent that is small enough not to leak prior to use of the compartmented lid or one that can be sealed with a closure as described above.

It is contemplated that any liquid that is introduced or injected into the compartmented lid is pasteurized, ultra-pasteurized and/or stabilized using technologies well known in the art and meeting FDA regulations. Liquids can be loaded into the compartment or wells at the time the lid is manufactured or injected at a later time. The volume of liquid is expected to vary relative to container size and product concentration as described above.

Compartmented lids in various sizes can be color-coded and/or labeled by the manufacturer or at the factory where they are filled. For example, a compartmented lid containing mocha concentrate can be tan to signify its contents. However, since there are many liquids and both the number of colors and color-blindness can be issues, labels affixed to or printed on the top or side of the lid or on the closure are preferred.

Utility

The liquid-dispensing apparatus or compartmented lid is useful for commuters who need to concentrate on driving rather than adding condiments to and stirring them into a beverage. It also can save time for the service representative at the take-out window who does not have time to pick up and individually load cream, creamer, milk, packets of sugar or sweetener, stirrers, and the like into a take-out bag. Similarly, the time devoted to maintenance and cleaning of a self-service island in any restaurant or other venue can be reduced.

The compartmented lid is also useful whenever convenience, refrigeration, storage and/or transportation are an issue. If its contents are ultra-pasteurized or otherwise stabilized, the compartmented lid can be stored without refrigeration in employee break areas or kitchens, in the self-serve dining areas of senior centers or assisted living facilities; at the counter selling ready-to-eat and drink items in mini-marts, gas stations, big-box stores, sports arenas, supermarkets, and the like. It is particularly useful in outdoor venues for sports activities such as athletic fields, athletic training camps, or summer camps including but not limited to baseball, bicycling, field hockey, football, golf, lacrosse, rugby, running, soccer, softball, swimming and the like; and personal or commercial boating, camping, fishing, hiking, and hunting trips where fewer, space-saving, non-refrigerated supplies are always a consideration.

The compartmented lid is also useful for emergency disaster relief (FEMA, Red Cross, Salvation Army, and the like) or for military use at home or overseas. Lack of refrigeration is often a concern in any disaster or war-zone location, but transportation and storage can also be large issues. Moreover, the ability to change water into a rehydrating or nutritional fluid in a timely fashion by adding a compartmented lid filled with liquified amino acids, minerals, salts, sugars, and/or vitamins can save lives.

Various modifications and variations of the compartmented lid, materials and methods for manufacturing and filling it will be apparent to those skilled in the art without departing from the scope and spirit of the invention. Although the invention has been described in connection with specific embodiments, it should be understood that the invention as claimed should not be unduly limited to these specific embodiments. Indeed, various modifications of the described material and methods for carrying out the invention that are known to those persons skilled in the art or related fields are intended to be within the scope of the following claims.

The invention claimed is:

1. A compartmented lid for conveying at least two liquids simultaneously, the compartmented lid comprising a lid, the lid further comprising a rim, a substantially flat top crowning the rim, the substantially flat top further comprising an exterior surface, an interior surface, at least one portal comprising an aperture for conveying a first liquid therethrough, a cover, and a compartment, wherein the compartment further comprises a baffle, the compartment further comprising a basin sealed to the interior surface of the top of the lid, the basin comprising a wall, wherein a portion of the basin wall comprises at least one channel for conveying at least one second liquid therethrough, and wherein the baffle subdivides the compartment for holding additional liquids.

2. The compartmented lid of claim 1 wherein the baffle provides support or structural integrity to the compartment.

3. The compartmented lid of claim 1 further comprising a second channel.

4. The compartmented lid of claim 1 further comprising a closure.

5. The compartmented lid of claim 1 wherein the closure is liquid- and beverage-resistant and adheres to the exterior surface of the top of the lid.

6. The compartmented lid of claim 1 wherein the lid is manufactured from liquid- and beverage-resistant materials.

7. The compartmented lid of claim 6 wherein the liquid- and beverage-resistant materials are paper or organic polymers selected from cellulosics, coated paper, nitrile resins, paper slurry, polybutylene, polyethylene, polyethylene terphthalate, polystyrene, polyvinylchloride thermoplastic resins, and thermosetting resins.

8. The compartmented lid of claim 1 wherein the lid is manufactured by at least one process selected from blow molding, die cutting, die pressing, die stamping, extrusion, vacuum infiltration, injection molding, rotational molding, thermoforming, thermoplastic molding and thermosetting.

9. The compartmented lid of claim 1 wherein the rim slopes vertically over its circumference.

10. The compartmented lid of claim 9 wherein the rim further comprising a peak and wherein the portal is located at the peak of the rim.

11. The compartmented lid of claim 1 wherein the aperture is pre-perforated.

* * * * *